US005263755A

United States Patent [19]

Thompson

[11] Patent Number: 5,263,755

[45] Date of Patent: Nov. 23, 1993

[54] PORTABLE CARRIER

[76] Inventor: Steven C. Thompson, 1043 Atchison, Pasadena, Calif. 91104-1318

[21] Appl. No.: 850,116

[22] Filed: Mar. 12, 1992

[51] Int. Cl.[5] ..... B65D 33/06

[52] U.S. Cl. ..... 294/165; 294/137

[58] Field of Search ..... 294/26, 137, 158, 165, 294/166; 24/30.52, 338, 339, 353

[56] References Cited

U.S. PATENT DOCUMENTS

| | | | |
|---|---|---|---|
| 2,324,638 | 7/1943 | O'Connor | 295/165 X |
| 2,592,389 | 4/1952 | Budy | 294/166 X |
| 2,603,520 | 7/1952 | Brown et al. | 294/26 |
| 2,778,555 | 6/1953 | Poryle . | |
| 3,888,535 | 6/1975 | Rosso | 294/26 X |
| 3,937,394 | 2/1976 | Netschert | 294/165 X |
| 4,112,541 | 9/1978 | Tetradis . | |
| 4,621,855 | 11/1986 | Kroll . | |
| 4,666,203 | 5/1987 | Castro . | |
| 4,818,121 | 4/1989 | Volk . | |

FOREIGN PATENT DOCUMENTS

| | | | |
|---|---|---|---|
| 447994 | 4/1948 | Canada | 294/158 |
| 6342 | 12/1878 | Fed. Rep. of Germany | 294/165 |
| 113180 | 2/1918 | United Kingdom . | |

*Primary Examiner*—David M. Mitchell

*Assistant Examiner*—Dean J. Kramer

[57] ABSTRACT

A portable hand held carrier for plastic, net or canvas bags and other similar handled objects which has an elongated handle section with hinge bosses fixed at the breech end, that is connected to an elongated connecting arm tongue with a hinge pin. The elongated handle section has an internal spring-loaded pull pin bougie that extends through both ends of the elongated handle section. The connecting arm section has a connecting arm locking hole which is to be engaged by the elongated handle section spring-loaded pull pin. The connecting arm section is convexed away from and biased from the elongated handle section. The spring-loaded pull pin can be retracted to disengage the connecting arm section from the elongated handle section which allows item handles to be passed on to and off of the connecting arm section and then to be re-engaged and hand carried by the elongated handle section. The spring-loaded pull pin in the elongated handle section has a pull pin annulus at one end and a bolt end at the other which extracts and retracts into the connecting arm locking hole of the connecting arm section. This spring-loaded pull pin passes through the connecting arm locking hole to prevent the elongated handle section and connecting arm section from becoming accidentally disengaged.

1 Claim, 1 Drawing Sheet

PORTABLE CARRIER

FIELD OF THE INVENTION

The present invention relates to the field of portable carriers for plastic or net bags and other objects, more particularly, to a recloseable durable carrier which makes it more comfortable and convenient to transport several items together by hand.

BACKGROUND OF THE INVENTION

It is commonly desired to carry a number of items together by hand at once. One such item for example, is a plastic shopping bag with integral plastic handle loops. The plastic loops do not fit the shape of a person's hand, and do not rest comfortably there and, therefore, it is difficult to carry large loads or several plastic bags together at one time. Similarly, paint cans often include a metal wire handle. While the handle may be inexpensive to apply to the cans, it is not comfortable to hold in the hand and is rarely large enough to allow more than two paint cans to be held in the hand at once. These items also present problems every time one desires to pick them up again after setting them down. The plastic handle loops of a typical carrying bag typically fall to the side in random directions so that the carrier must gather up all of the loops before the bags can be carried. The wire paint can handles similarly fall to the side and must also be collected together before the cans be carried.

British Patent No. 113,180 to Earle shows a carrier to make string tied parcels more comfortable to carry by hand. The carrier has a lower limb with corrugations so that if a number of parcels are to be carried at once, they can be distributed along the length of the limb to keep the parcels balanced. Although the carrier does allow several parcels to be carried at once, it requires careful attention on the part of the user to maintain the parcels balanced about the handle. In addition, to allow the carrier to bear heavier loads additional suspending links are added to support the lower limb at intermediate points along its, length, this makes it more difficult to disconnect the lower limb from the upper limb and also to engage the lower limb with parcel strings. If the carrier of Earle were allowed to bend, the purpose of the corrugations might be defeated.

U.S. Pat. No. 4,112,541 to Tretadis shows a handle for carrying bags of net or plastic material. The handle has a lower limb to secure and attach the bags to it by clamping them, however if the lower limb was to become unattached, the handle then would be unable to perform its designed purpose. This design is unable to carry items with nonflexible carrying handles.

Canadian Patent No. 477,994 to Young, shows a bailshaped holder for sorting record cards. It should be obvious, however, to those skilled in the art, that my present invention cannot perform the duties of such small holes as required in the key cards. On the other hand, Young's sorting device cannot withstand the weight of carrying items on its sorting rod, of which has a dangerous point and can harm the user. Also, if sorting cards shift on Young's device, the balance of his device shifts, which can result in the loss of control of his device.

SUMMARY OF THE INVENTION

The present invention allows the user to more comfortably carry one or more objects which themselves have inadequate handles. The carrier can be quickly engaged with the handle of a plastic bag, a paint can or many other objects, so that these objects can be carried by its comfortable convenient handle. The items are naturally held balanced about the handle and the carrier is capable of bearing very large loads without becoming disengaged. In addition, it is easy to operate, can be conveniently stored out of the way when not in use and serves to hold items together when the items are not being transported.

In one embodiment, the carrier has an elongated handle section with a spring loaded pull pin that extends from one end past the other, it is retracted by pulling the pull ring back, and releasing it to engage or disengage the elongated carrier section, with a latching hole directly in line to engage the handle section spring loaded pull pin. The other end of the carrier section is connected to the end of the handle section by a hinge, opposite the handle section spring loaded pull pin extension, and the carrier section is curved away from the handle section between its two ends. The carrier preferably is formed from two pieces of strong molded plastic, preferably carbon reinforced plastic. The carrier preferably includes a hinge pin connecting the handle section and the carrier section for biasing the carrier section away from the handle section. The handle section spring loaded pull pin preferably has an extension outward to connect carrier section and then ends in a U-shape. The carrier section has a latching hole directly in line with the handle section spring loaded pull pin. The carrier section is preferably curved away from the handle section in the shape of a partial parabola or partial circle. The handle section is formed to fit comfortably in the hand of the user while the carrier is in use.

In another embodiment, the invention comprises a carrier with an elongated handle portion, one end of which has an extended pull pin and an elongated carrier portion. The carrier portion has a latching hole directly in line to engage the handle portion spring loaded pull pin, at the other end of the handle portion, opposite the handle portion extended pull pin, is a hinge to connect the carrier portion to the other end. The carrier portion is spaced apart from the handle portion, so that when the spring loaded pull pin is disengaged, items can be passed between the handle portion and the carrier portion, to be engaged by the carrier portion.

The carrier portion is curved away form the handle portion so that when the carrier is held from the handle portion, items engaged by the carrier portion are drawn together. Preferably, the carrier includes a handle located so that when the carrier is held from the handle items engaged by the carrier portion are drawn to a point adjacent to the midpoint of the handle.

REFERENCE NUMERALS IN DRAWING

Figure 1:
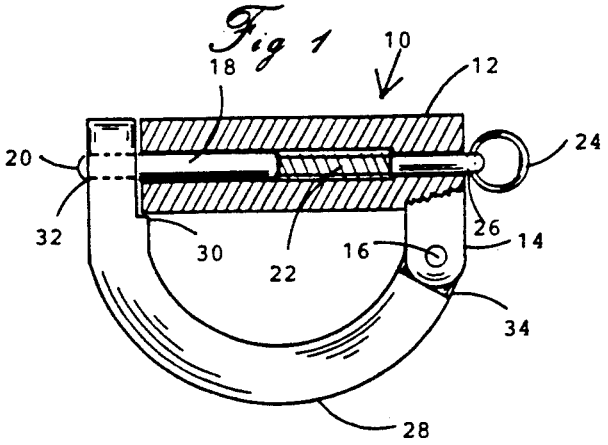
FIG. 1 is a side elevational view of the carrier according to the present invention with its spring loaded pull pin engaged.
Figure 3:
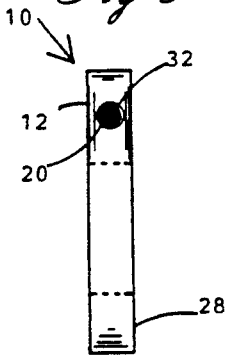
FIG. 3 is a front elevational view of the carrier of FIG. 1; with the spring loaded pull pin engaged.
Figure 2:
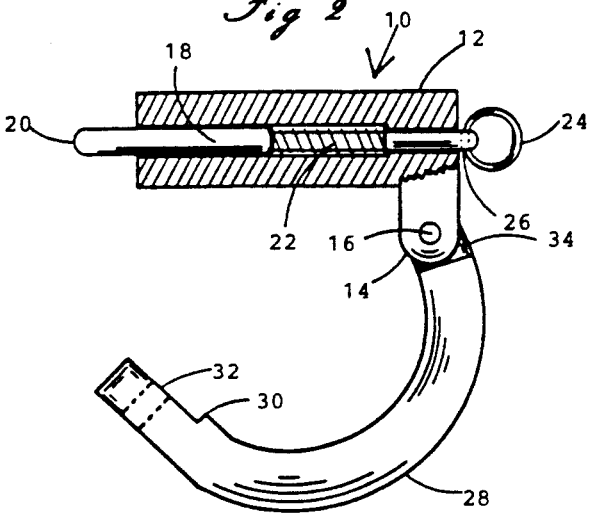
FIG. 2 is a side elevational view of the carrier of FIG. 1; with its spring loaded pull pin disengaged.
Figure 4:
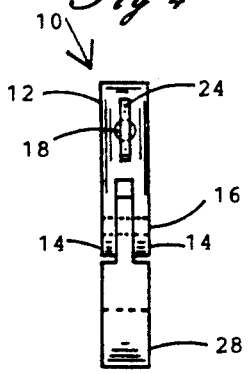
FIG. 4 is a rear elevational view of the carrier of FIG. 1; of the pull pin pull ring and hinge.
Figure 5:
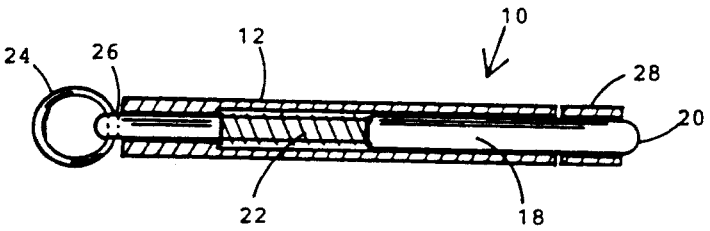
FIG. 5 is a top elevational view of the carrier of FIG. 1; with the spring loaded pull pin engaged.

| Reference Numerals in Drawing | |
|---|---|
| 10 Portable carrier | 20 Latching hole |
| 12 Handle section | 22 Spring loaded pull pin |
| 14 Carrier section | 24 Pull pin spring |
| 16 Hinge | 26 Pull pin ring |
| 18 Hinge pin | |

DETAILED DESCRIPTION

A carrier 10 according to the present invention is s preferably made from two pieces of strong molded plastic hinged 16 together into the configurations shown in the drawings. The strong molded plastic is preferred because it is durable, safe and relatively inexpensive. However, a variety of other materials may be used including metals, graphite composites and fiberglass materials. However, it is preferred, that the material used be durable so that it will withstand extensive use. The material may be colored by changing the pigment to enhance its appearance. The plastic is molded in two pieces so as to form an upper handle section 12 and a lower carrier section 14. The handle and carrier sections are joined together by a hinge pin 18. The hinge 16 is formed so that the carrier section is biased away from the handle section.

The handle section 12 is elongated and extends from a hinge 16 at one end, to the extension of the spring loaded pull pin 22 at the other end. The carrier section 14 is also elongated and extends from the hinge 16 around to the latching hole 20. The spring loaded pull pin 22 is preferred because it insures that the handle section 12 and the carrier section 14 will not accidentally become disengaged.

The carrier can be used with a variety of different items. Carrier use begins when the spring loaded pull pin 22, and the latching hole 20 are disengaged. Since the carrier section and the handle section 12 are spaced apart from each other, this leaves a gap between handle section 12, the spring loaded pull pin 22 and the carrier section 14, latching hole 20. This opening between the handle section 12 and the carrier section 14, through where items may be passed. The carrier can be used to an advantage, for example, with typical plastic shopping bags.

The shopping bags typically have holes near their upper ends on either side of the bag, intended for carrying purposes. With the spring loaded pull pin 22 disengaged from the carrier section latching hole 20 the carrier can be passed through the two holes of the shopping bag and then the carrier section 14 is pushed upwards, pass the retracted spring loaded pull pin 22 by the pull ring 26 of the handle section 12. It will not re-engage until the carrier section 14 latching hole 20 becomes directly in line with the spring loaded pull pin 22 and then is released as illustrated in FIG. 1. The two handles of the plastic bag are now held close to each other and the plastic bag can be carried by the much more comfortable handle 12 of the carrier 10.

The carrier 10 is of particular benefit when several plastic bags are to be carried at once. The carrier section 14 can be looped through the handles of 4 or more shopping bags so that all 4 shopping bags can be carried by one hand (see FIG. 6). This is normally awkward and inconvenient because 8 different plastic bag handles have to be looped over the hand and the weight of the sharp plastic bag handle edges pushing into the hand's skin, make the bags uncomfortable to hold. With the present invention, once the lower carrier section 14 is looped through the 8 handles of the 4 shopping bags the weight of all 4 bags can comfortably be held by the carrier's own handle 12. The bags can be placed in the trunk of a vehicle without disconnecting the carrier so that when it comes time to carry the bags from the vehicle to their next location, the 8 separate plastic bag handles are already collected together. The user simply grabs the handle and lifts.

Figure 6:
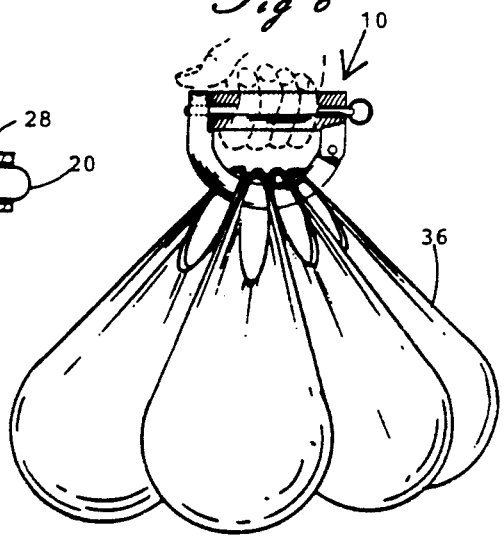
FIG. 6 is a side elevational view of the carrier of FIG. 1; in use carrying plastic shopping bags.

In addition, since the carrier section 14 is curved away from the handle section 12, the handles of all 4 shopping bags are drawn towards the middle of the carrier section 14 (see FIG. 6). Preferably, the lowest point on the carrier section 14 is directly across from the midpoint of the handle on the handle section 12, this insures that the plastic bags are balanced across the handle section 12 and the user's hand is not pulled in one direction or the other. The carrier section 14 can be curved in a rough partial parabola as shown in the figures or in more of a partial circle depending on what is to be carried.

The carrier can be used to carry a large variety of other items which are normally uncomfortable to carry in the hand. Any item with a handle loop or hole large enough for carrier section 14 of the carrier 10 to pass through can be carried by the carrier portion 14. Many consumer items for example are wrapped with plastic or metal strapping tape. The carrier section 14 can be looped underneath the strapping tape so that the item can be carried by the comfortable handle instead of by holding the strapping tape. Paint cans are also uncomfortable to hold by their provided handles. The metal wire handles of a typical gallon paint can, can easily be carried by the carrier portion 14 of the present invention so that 2 or 3 paint cans can be held in one hand by the comfortable handle.

This advantage applies to many other things as well. Diverse items with straps or loops of many types can also be conveniently carried, for example, the heel straps of scuba fins and head straps of face masks can all be looped over the carrier portion 14 so that these items can all be carried at once in one hand.

In the presently preferred embodiment for carrying shopping bags, paint can, and a large variety of other items, the handle section 12 is approximately 9 centimeters long and the carrier section 14 is approximately 18 centimeters long. The hinge pin 18 is approximately 2 centimeters long and 4 millimeters in diameter and the spring loaded pull pin 22 is approximately 10.5 centimeters long and 5 millimeters in diameter. The pull pin spring 24 is approximately 4 centimeters long and 4 millimeters in diameter and the pull ring 26 is approximately 2.5 centimeters in diameter. These dimensions may be varied, however, for different applications. If the dimension were increased larger items could be carried or towed. While it is presently preferred that the carrier be formed from two pieces of strong molded plastic, it can be constructed of rigid materials so that it can become even more durable.

The curve in the carrier section 14 cooperates with the spring loaded pull pin 22 of the handle section 12 and carrier section 14 latching hole 20 to help ensure that the carrier section 14 does not become disengaged, even when a very substantial weight is being carried.

However, since the carrier section 14 is already gently curved in the direction of the downwards pull from a heavy load, it is only slightly deformed, if at all. In addition, because of the spring loaded pull pin 22 in the handle section 12 it extends directly away from the handle section 12 into the carrier section 14 latching hole 20.

In some prior art devices, the ability of the device to perform rely on a link that can be broken off, making the device unable to perform its designed capability. Some devices have ends that can cause injuries to the user and others are limited to their abilities.

While only a few embodiments have been described herein, a variety of adaptations and modifications may be made without departing from the spirit and scope of the present invention. The inventor does not intend to abandon these modifications and adaptations by not describing them in detail in the aforementioned.

What is claimed is:

1. A parabola-shaped portable hand held carrier for plastic, net, or canvas shopping bags comprising two pieces of strong molded plastic, the first piece being a stationary elongated handle section and the second piece being a parabola-shaped carrier section, wherein the elongated handle section contains a retractable internal spring-loaded locking pull pin that extends through both ends of said elongated handle section, wherein a breech end of the pull pin contains a complemental dual purpose pull pin ring for easy retraction and the opposite end of the pull pin can selectively project through a latching hole located in said carrier section, the carrier section further comprising a tongue at the breech end thereof pivotally connected with the elongated handle section at a stationary pin thereby allowing said carrier section to swing open in a downward position upon disengagement from said pull pin to easily load or unload said shopping bag handles over said carrier section then to re-engage with said spring-loaded pull pin for locking thereto, whereby said elongated handle section is adapted to be easily and comfortably gripped by a person's hand for transporting and the parabola shape of the carrier section forcing the handles of said shopping bags toward the middle of the carrier.

* * * * *